US007320254B1

(12) United States Patent
Martin

(10) Patent No.: US 7,320,254 B1
(45) Date of Patent: Jan. 22, 2008

(54) HAND-HELD TORQUE MEASURING DEVICE

(76) Inventor: Wendell Martin, P.O. Box 145, Fort Smith, AR (US) 72902-0145

( * ) Notice: Subject to any disclaimer, the term of this patent is extended or adjusted under 35 U.S.C. 154(b) by 76 days.

(21) Appl. No.: 11/221,401

(22) Filed: Sep. 7, 2005

Related U.S. Application Data

(63) Continuation-in-part of application No. 60/607,532, filed on Sep. 7, 2004.

(51) Int. Cl.
*B25B 23/142* (2006.01)
*B25B 23/147* (2006.01)

(52) U.S. Cl. ..... 73/862.21; 73/862.23

(58) Field of Classification Search ..... 73/862.21, 73/862.23, 862.191
See application file for complete search history.

(56) References Cited

U.S. PATENT DOCUMENTS

| | | | | |
|---|---|---|---|---|
| 164,100 | A | 6/1875 | Plymale | |
| 2,365,419 | A | 12/1944 | Lockheed | 73/139 |
| 2,791,904 | A | 5/1957 | Campbell | 73/139 |
| 3,866,463 | A | 2/1975 | Smith et al. | 73/99 |
| 4,315,427 | A | 2/1982 | Leiter et al. | 73/52 |
| 4,494,358 | A | 1/1985 | Zalkan | 53/331.5 |
| 4,506,250 | A | 3/1985 | Kirby | 338/5 |

(Continued)

OTHER PUBLICATIONS

Mountz Incorporated, TorqueMate® Plus Operation Manual Version 2.1, <http://www.etorque.com/assets/multimedia/TorqueMate_Plus_Manual.pdf>, Accessed online on Mar. 16, 2007.*

*Primary Examiner*—Edward Lefkowitz
*Assistant Examiner*—Punam Patel
(74) *Attorney, Agent, or Firm*—Keisling Pieper & Scott PLC; David B. Pieper; Trent C. Keisling

(57) ABSTRACT

An ergonomic wedge shaped torque tester with multiple push buttons to control the use and recording functions. The top of the device has a single on/off button, a display screen to display the results of the test, two push buttons for scrolling through the various saved test results one scrolls up the other scrolls down. The device can easily be grasped by the right or left hand. This shape makes it possible to place the chuck portion of the tester on a bottle cap, grasp the device with your hand from the top or side and turn in a clockwise or counterclockwise direction. The chuck is connected into a strain gauge connected on a shaft that utilizes a transducer to measure the strain in accordance with deflection of the metal shaft. The output of the transducer is connected through an amplifier into a microprocessor which utilizes the information from the transducer to record the maximum amount of strain or torque applied to the bottle cap. The microprocessor is connected to a serial output on the device so the information may be downloaded to a computer and the output is also provided to a video screen which is provided as a monochromatic LCD screen for giving a visual indication of the torque measurement to the user. The output may be recorded into a register by the pushing of a store button and the value inside the register may be reset by pushing the reset button. The input is a dynamic input and preferably only the maximum positive or negative value is recorded into the register. Up to 100 different registers may be used for stores in the microprocessor system. Control inputs include power, up scrolling, down scrolling, store, and reset.

20 Claims, 13 Drawing Sheets

U.S. PATENT DOCUMENTS

| | | | | | |
|---|---|---|---|---|---|
| 4,539,852 | A | | 9/1985 | Feld | 73/847 |
| 4,674,340 | A | | 6/1987 | Burt et al. | 73/862.23 |
| 4,702,129 | A | * | 10/1987 | Allen | 81/3.09 |
| 4,716,772 | A | | 1/1988 | Bubeck et al. | 73/862.23 |
| 4,794,801 | A | | 1/1989 | Andrews et al. | 73/862.23 |
| 4,808,976 | A | | 2/1989 | Kiefer et al. | 340/665 |
| 4,811,850 | A | | 3/1989 | Bankuty et al. | 209/546 |
| 4,976,159 | A | | 12/1990 | Snyder et al. | 73/862.21 |
| 5,107,727 | A | | 4/1992 | Klefbeck | 81/3.4 |
| 5,319,984 | A | | 6/1994 | Humphries et al. | 73/862.21 |
| 5,415,050 | A | | 5/1995 | Trendel et al. | 73/862.23 |
| 5,501,107 | A | | 3/1996 | Snyder et al. | 73/862.23 |
| 2004/0083821 | A1 | * | 5/2004 | Semersky | 73/862.23 |

* cited by examiner

HAND-HELD TORQUE MEASURING DEVICE

CROSS-REFERENCE TO RELATED APPLICATIONS

This application claims priority to and is a continuation-in-part of patent application Ser. No. 60/607,532, filed Sep. 7, 2004.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION

1. Field of the Invention

The present invention relates to the field of torque measurement in general. In particular, the present invention relates specifically to a hand held torque measuring apparatus and method used primarily to measure the torque required to unscrew a closure cap from a bottle. The prior art teaches the use of fixtures with mechanical gripping surfaces and controlled environments for measuring the torque used to tighten or loosen a bottle cap. The present invention overcomes these non-real world measurements by replicating the grasping of the bottle and the turning of the cap by hand with a method for recording each test in a torque testing device.

2. Description of the Known Art

As will be appreciated by those skilled in the art, a bottle cap should be securely sealed to a bottle to prevent leaks, but should remain easily opened by the hands of a user. Twist caps have long been used to seal the contents of bottles prior to shipment and sale and provide the easy opening fixture for a user. By providing at least vestigial threads on the cap and bottle top, rotation of the cap in one direction with respect to the bottle fixedly and sealingly connects the cap to the bottle top, while rotation of the cap in the opposite direction is required to remove the cap from the bottle prior to dispensing contents of the bottle. Such a packaging system is used in a wide variety of industries for a wide variety of goods and the bottles and caps take a wide variety of forms such as soda bottles, chemical containers, medicine bottles, etc. . . . In the pharmaceutical industry, for example, the "bottle and cap" may be of various forms and materials and may be known by a variety of names. For convenience in this application, it will be understood that the terms "bottle" and "cap" are used in a broad sense and it will be understood that by a bottle with a twist cap is meant essentially in a container with a cover whose placement and removal involves a relative twisting motion.

Station based container cap torque testers are commonly used in connection with commercial container filling lines wherein plastic, glass or metal containers are filled with liquids or powders and then automatically capped by machinery which clamps the containers at a work station and rotates threaded container caps onto the containers at the work station. Variations in the torque with which the caps are tightened onto the containers occur during the capping process for a number of reasons, including changes in manufacturing tolerances for the threaded container caps and containers, variations in pneumatic line pressures and electrical voltages employed in the machinery used in the container capping operation, wear on the container clamping and/or cap grasping members employed therein, and changes in ambient temperature and humidity during the container capping operation.

The variations in the torque with which the caps are tightened onto the containers results in the another arising of potentially significant problems in connection with the handling and/or usage of the capped containers. For example, containers having insufficiently torqued container caps are subject to leakage during packing and shipping, and containers having caps which are excessively torqued present problems for the ultimate consumer when he or she attempts to remove the container cap to use the product therein.

Torque testers have been employed to check the torque level at which container caps have been applied to containers. Previously utilized torque testers have been used to clamp a bottle using either the lifter ring or the petaloid shape to hold the bottle in position. By using the lifter ring, an accurate reading of the head to cap measurement is obtained, but the measurement fails to measure the real world torque due to the deflection caused by the thin walled plastic of the bottle such as that found in soda bottles. The petaloid bottom clamping systems may prove to be inaccurate due to the full deflection of the bottle across the entire vertical span of the bottle. With the advent of highly efficient bottle designs which are continuously reducing the amount of plastic or material in the bottle, it is becoming extremely desirable to obtain quick accurate measurements of the real world bottle opening torque.

Strain gauges based on piezo-resistance effect, are well known. Metal and alloy wires were used as an early form of strain gauge and more recently, thin sheets of metal or foil bonded to the surface of an object in which the strain is to be measured, or thin films evaporated onto the surface of such an object, or thin pieces of semiconductor material bonded onto such a surface have all been used. All of these devices are capable of providing accurate and repeatable indications of the magnitude of both tensile and compressive strain on the surface of an underlying supporting member. Such devices are widely used in the field of precision engineering for strain measurement or stress analysis or in the manufacture of high quality transducers such as load cells or force or pressure transducers for the measurement of force, pressure or weight. Sophisticated industrial weighing systems and weighing platforms and expensive weighing machines or scales used in trade or commerce are provided for by these known devices which can frequently measure to an accuracy of 0.1% or better under all required operating conditions.

Also of note in the prior art is the description of the circuit board and microprocessor based engine used in the present invention. The MC2000-077 is designed for general use applications of moderate size, especially those that require powerful communication functions and low power usage, on a physically tiny device. The MC2000-077 features five 10 bit A/D signals, up to 21 DIO signals, 2 serial connectors on the Dev-07X board (COM & DEV), with the option of adding two more using the V2Serial peripheral. Low-power modes can be controlled with Vesta Basic. The MC2000-077 provides users with a feature-packed programming environment. The device features 32-KB application space, 10-bit ADCs, powerful communications capabilities, and background monitoring of 12 digital bits. The MC2000-077 provides 100 bytes of variable RAM space and sports an enhanced version of Vesta Basic, supporting four buffered serial ports, (three with 8-byte buffers and one with a 72-byte buffer), and enhanced communications functions. And, it comes in a tiny ($0.96^2 \times 0.96^2$) package. The MC2000-077 provides signal support for five 10-bit ADCs, 21 DIO, two serial ports, an LCD, a keypad, and a Vesta Addressable Synchronous Transfer (VAST) bus. The new Dev-07X prototyping board provides connectors for development purposes. Two additional serial ports are available using the VAST V2SERIAL board. The VAST bus provides signal access to a range of Vesta peripherals including various relays, opto-isolated inputs, 8-, 10-, 12-, and 24-bit ADCs, multiple ADC and DIO combinations, and various LED options. RS-232 signals on the Dev-07X board can be easily converted to RS-485 with a RS-485 adapter.

Numerous torque and related testing devices are illustrated in the patent database including: United States Statutory Invention Registration Number H1777 published Feb. 2, 1999 for Colby; U.S. Pat. No. 164,100 issued to Plymale on Jun. 8, 1875; U.S. Pat. No. 2,365,419 issued to Lockheed on Dec. 19, 1944; U.S. Pat. No. 2,791,904 issued to Campbell on May 14, 1957; U.S. Pat. No. 3,866,463 issued to Smith on Feb. 18, 1975; U.S. Pat. No. 4,506,250 issued to Kirby on Mar. 19, 1985; U.S. Pat. No. 4,315,427 issued to Leiter on Feb. 16, 1982; U.S. Pat. No. 4,539,852 issued to Feld on Sep. 10, 1985; U.S. Pat. No. 4,494,358 issued to Zalkin on Jan. 22, 1985; U.S. Pat. No. 4,674,340 issued to Burt on Jun. 23, 1987; U.S. Pat. No. 4,716,772 issued to Bubeck on Jan. 5, 1988; U.S. Pat. No. 4,794,801 issued to Andrews on Jan. 3, 1989; U.S. Pat. No. 4,808,976 issued to Kiefer on Feb. 28, 1989; U.S. Pat. No. 4,811,850 issued to Bankuty on Mar. 14, 1989; U.S. Pat. No. 4,976,159 issued to Snyder on Dec. 11, 1990; U.S. Pat. No. 5,107,727 issued to Kiefbeck on Apr. 28, 1992; U.S. Pat. No. 5,501,107 issued to Snyder on Mar. 26, 1996; U.S. Pat. No. 5,319,984 issued to Humphries on Jun. 14, 1994; and U.S. Pat. No. 5,415,050 issued to Trendel on May 16, 1995. Each of these patents are hereby incorporated by reference in their entirety.

U.S. Pat. No. 4,506,250 discloses a strain gauge or transducer is provided incorporating a supported film electrical resistance element whose electrical resistance varies as a function of applied mechanical strain and is provided with electrically conductive terminals. The resistance element comprises a dispersion of electrically conductive or resistive particles in an organic polymer together with an optional electrically insulating filler material. In a particular embodiment, the resistance element is supported on a member of anodized aluminum.

U.S. Statutory Invention Registration No. H1777 issued to Colby on Feb. 2, 1999 describes a torque wrench for manually applying a screw cap on a threaded opening of a container. The torque wrench includes a handle portion which engages a dome that releasably receives a neck ring insert. The insert engages the cap and applies a consistent amount of torque thereto by the use of a draft angle or curved portion on an inner surface which tightly engages the curved top edge of the cap. The insert may be sized to accommodate different sized caps.

U.S. Pat. No. 2,791,904 issued to Campbell on May 31, 1955 describes an improved tool for testing and adjusting the torque of a screw or the like on a small assembly which can be held in the hand of the operator.

U.S. Pat. No. 4,539,852 issued to Feld on Sep. 10, 1985 describes a vial cap torque tester which is capable of measuring the torque required to turn a cap, typically made of aluminum, on a rubber stoppered vial. The torque tester of the invention is comprised of a base which holds a torque gauge. The torque gauge has a gripper adapted to hold the bottom of a vial thereon. The device is further comprised of an apparatus for attaching to and turning the cap of the vial. That device is comprised of a spring having an inner diameter which is somewhat less than the outer diameter of the aluminum cap which compresses the rubber stopper on the vial. The spring is attached to a cylindrical handle at one end and to a concentric cylindrical housing at the other end. A torque arm is connected to the cylindrical housing such that by turning the torque arm relative to the cylindrical handle in a direction which opens the coils of the spring, the spring can be placed over the cap. Another release of the handle relative to the torque arm causes the spring to close down upon the cap. If a turning force is applied to the torque arm in the direction which closes the coils of the spring, the cap will be held tightly while the vial turns the torque tester to achieve a maximum torque prior to slippage of the cap on the vial. At the point of slippage of the cap on the neck of the vial, the maximum torque registered by the torque gauge indicates the actual amount of torque required to cause slippage of the cap.

Such devices do not, however, provide a solution to the need for low cost simple forms of force measuring transducers or hand-held recordable torque measuring devices such as bottle capping, or for simple industrial control purposes.

It is therefore an object of the invention to provide a torque measurement device that is ergonomically held in ones hand.

It is another object of the invention to provide a torque measurement device that does not require an external work holder.

It is another object of the invention to provide a torque measurement device that can be held in many different positions as to mimic the natural movement of a human hand.

It is another object of the invention to provide an easy to read display with memory to record the data.

It is another object of the invention to provide a device with simple push button controls.

Thus, it may be seen that these prior art patents are very limited in their teaching and utilization, and an improved torque measuring device is needed to overcome these limitations.

SUMMARY OF THE INVENTION

The present invention is directed to an improved hand held torque measuring apparatus and method. In accordance with one exemplary embodiment of the present invention, a torque measuring apparatus is provided for that is adapted to be held by digits and a palm of a hand of a user for measuring the torque required for turning a bottle cap connected by threads to a bottle. The present invention provides additional utility because its hand held nature allows the to be held by a second hand of the user. The torque measuring apparatus includes a body adapted to be held by the first hand of the user with a strain gauge mounted to the body. The strain gauge is connected to a cap chuck adapted to fit the bottle cap. The strain gauge is adapted to output a torque signal to a microprocessor electrically connected to the strain gauge. The microprocessor may then be used to record a measurement associated with the torque signal upon input from a store control switch electrically connected to the microprocessor. The store control switch is operable by one of the fingers or thumb of the use on the same hand that is holding the apparatus.

An additional item of note on the apparatus is a reset control switch that is electrically connected to the microprocessor. The reset control switch is also operable by at least one of the digits on the same holding hand of the user.

A further item of note is the use of a power control switch electrically connected to the microprocessor which is operable by a same hand finger.

Yet a further control function is activated by the use of a scroll-up control switch electrically connected to the microprocessor, and a complimentary function is provided for by the scroll-down control switch Output to the user is provided by the display screen electrically connected to the microprocessor which provides a visual output for the apparatus. Specifically, the display screen is adapted to provide an indication of a register identifier, an indication of a register value, and an indication of a current measured value.

A still further item of interest is the provision of an output port electrically connected to the microprocessor.

A method for measuring the hand held torque for twisting a cap in relation to a bottle as held by a user in the user's first and second hands is also provided. This method may include the actions of holding the bottle in the first hand; holding a torque measuring device in the second hand; and using at least one digit on the second hand for activating a store function in a microprocessor system used to measure and register the torque. Additional actions may include activating a reset function, and advancing to a another register.

Thus, one may see that in accordance with the present invention there is provided an ergonomic wedge shaped torque tester with multiple push buttons to control the use and recording functions. The top of the device has a single on/off button, a display screen to display the results of the test, two push buttons for scrolling through the various saved test results one scrolls up the other scrolls down. The device can easily be grasped by the right or left hand. This shape makes it possible to place the chuck portion of the tester on a bottle cap, grasp the device with your hand from the top or side and turn in a clockwise or counterclockwise direction. The chuck is connected into a strain gauge connected on a shaft. Basically this utilizes a transducer which measures the strain on a deflection of the metal shaft. The output of the transducer is connected through an amplifier into a microprocessor which utilizes the information from the transducer to record the maximum amount of strain or torque applied to the bottle cap. The microprocessor is connected to a serial output on the device so the information may be downloaded to a computer and the output is also provided to a video screen which is provided as a monochromatic LCD screen for giving a visual indication of the torque measurement to the user. The output may be recorded into a register by the pushing of a store button and the value inside the register may be reset by pushing the reset button. Note that the preferred embodiment uses an input that is a dynamic input and only the maximum positive or negative value is recorded into the register. Up to 100 different stores may be performed into a hundred different registers utilized in the microprocessor. The blue button on top of the unit is the power button the two buttons on the opposite side of the monochromatic screen are scrolling through the registers up and down, the two buttons on the side of the unit are the upper button the store button, the lower button the reset button. The reset button zeros the current read so that the value may be obtained, the current read may then be stored into the last register by pushing the store button.

These and other objects and advantages of the present invention, along with features of novelty appurtenant thereto, will appear or become apparent by reviewing the following detailed description of the invention.

BRIEF DESCRIPTION OF THE SEVERAL VIEWS OF THE DRAWINGS

In the following drawings, which form a part of the specification and which are to be construed in conjunction therewith, and in which like reference numerals have been employed throughout wherever possible to indicate like parts in the various views.

For purposes of clarity and brevity, like elements and components will bear the same designations and numbering throughout the Figures.

DETAILED DESCRIPTION OF THE INVENTION

Figure 1:
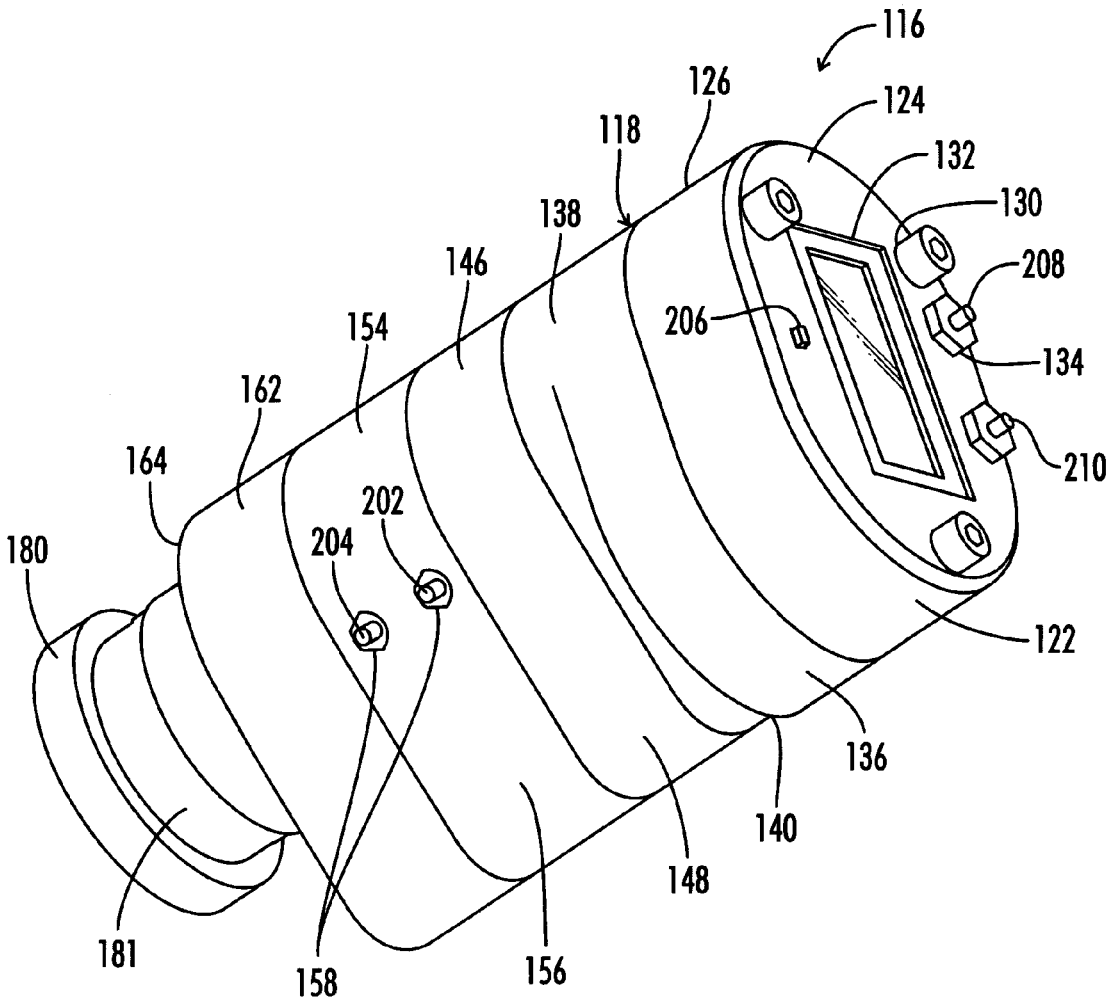
FIG. 1 is a top side elevational view of an exemplary embodiment of the present invention.
Figure 2:
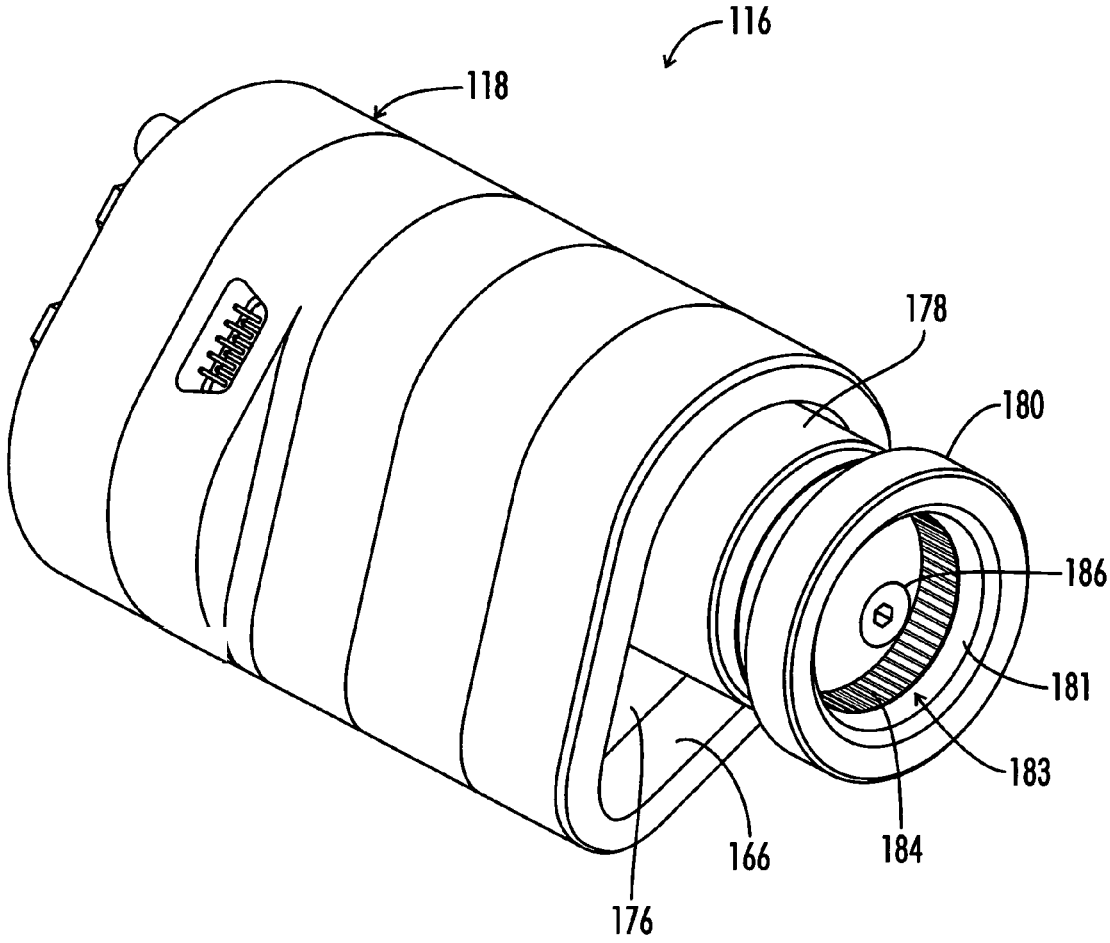
FIG. 2 is a bottom side elevational view of the embodiment of FIG. 1.
Figure 3:
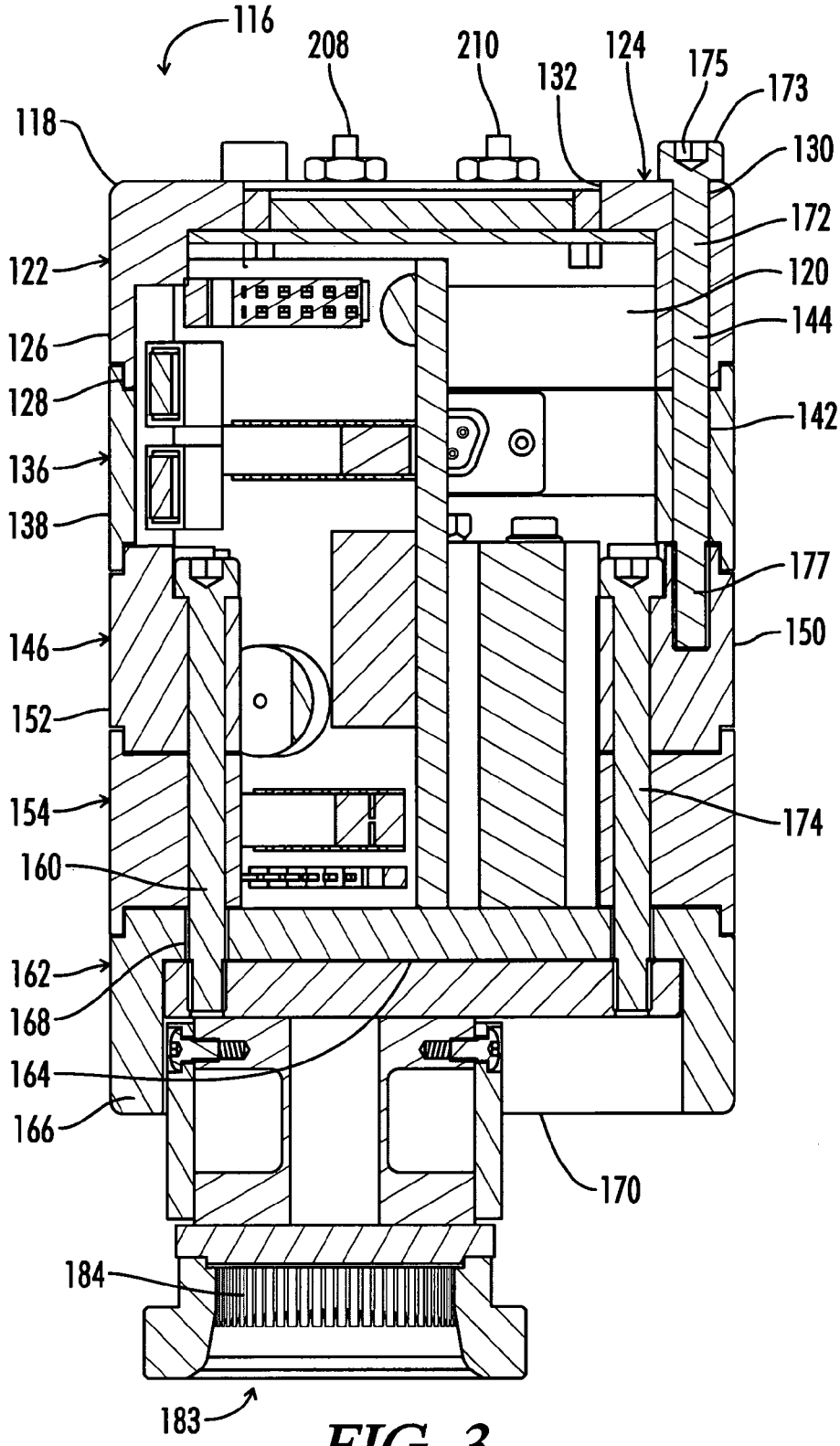
FIG. 3 is a schematic cutaway view showing the internal structure and arrangement of the embodiment of FIG. 1.
Figure 4:
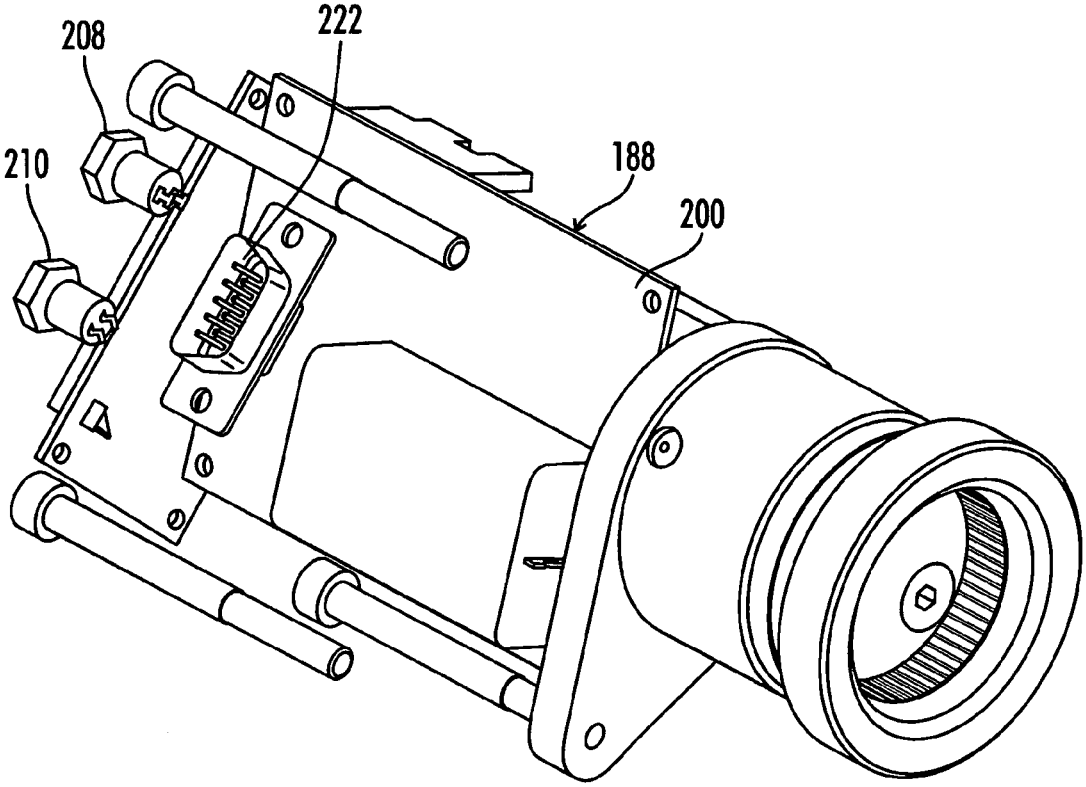
FIG. 4 is an internal view showing a first side of the internal structure and arrangement of the embodiment of FIG. 1.
Figure 5:
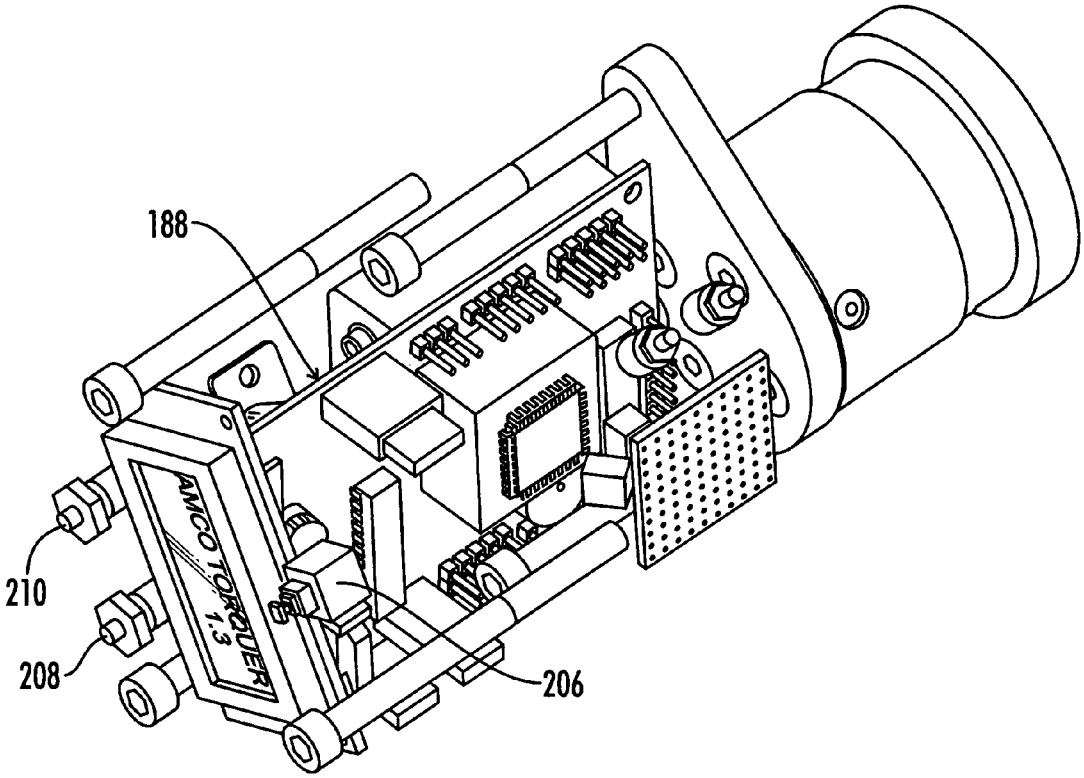
FIG. 5 is an internal view showing a second side of the internal structure and arrangement of the embodiment of FIG. 1.
Figure 6:
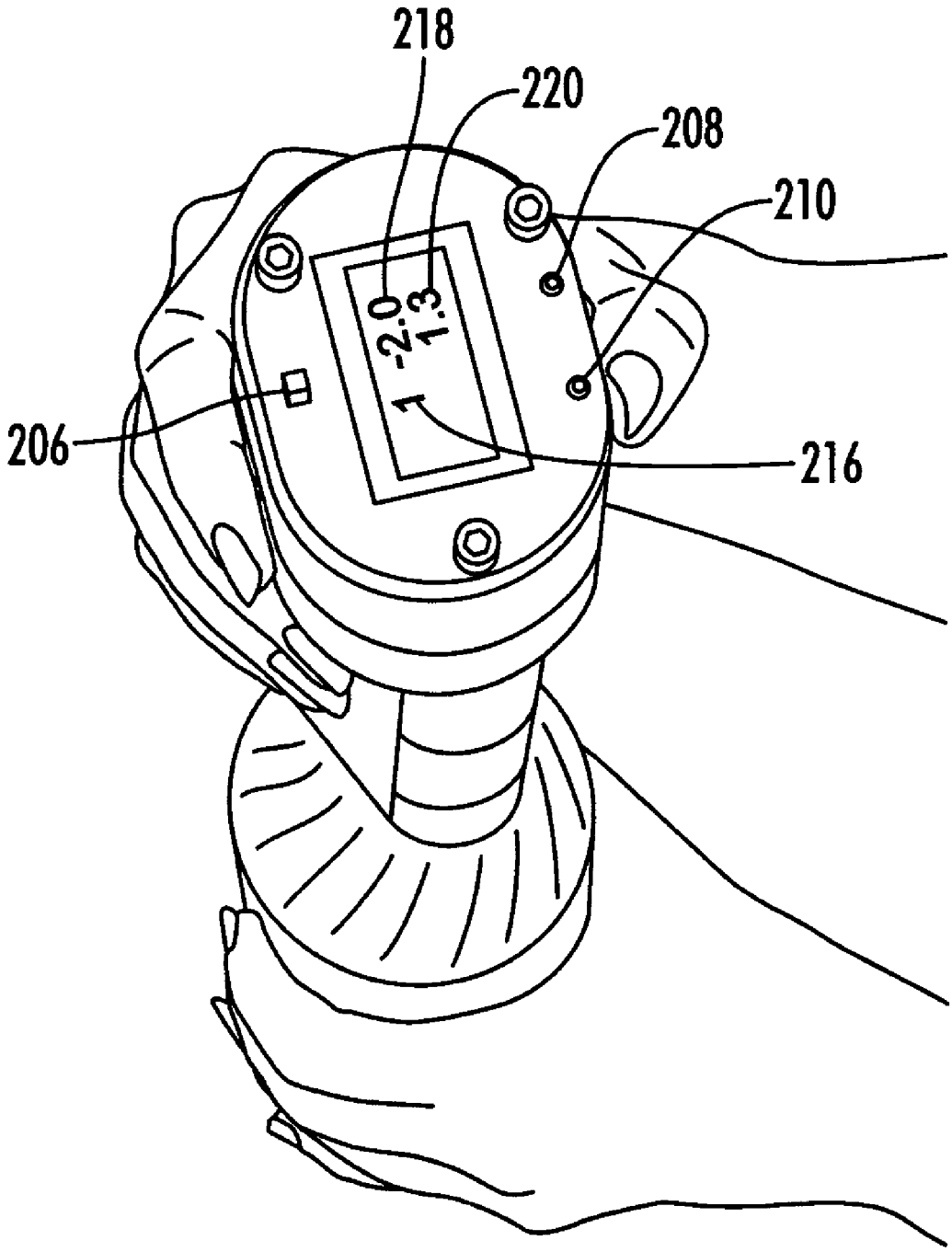
FIG. 6 is a top side elevational view of an exemplary embodiment of the present invention shown as held by a user.
Figure 7:
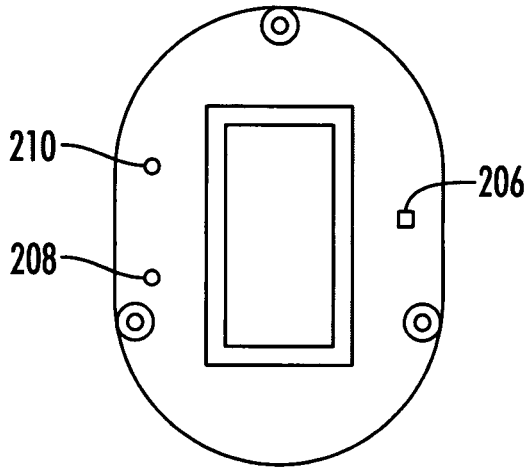
FIG. 7 is a bottom side elevational view of the embodiment of FIG. 1.
Figure 8:
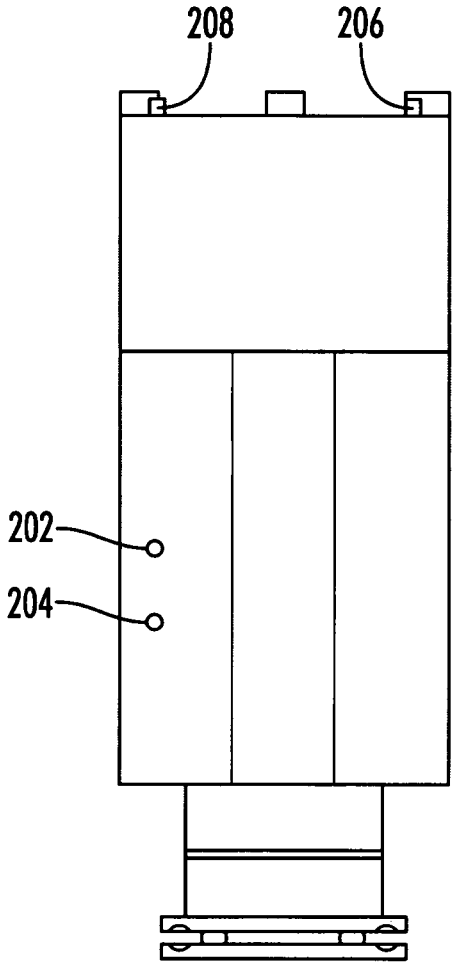
FIG. 8 is a front view of the embodiment of FIG. 1.
Figure 9:
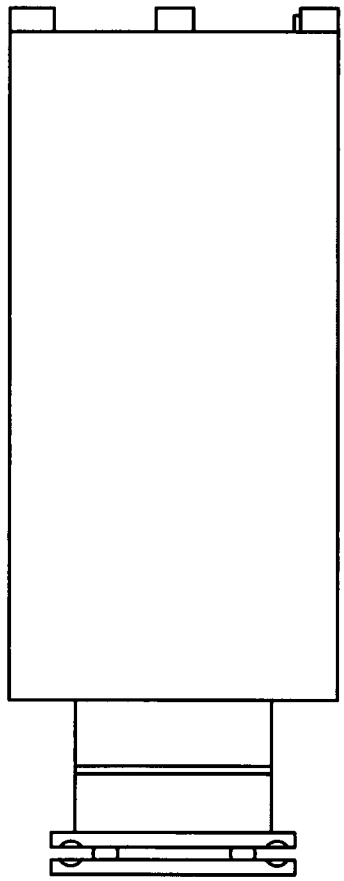
FIG. 9 is a back view of the embodiment of FIG. 1.
Figure 10:
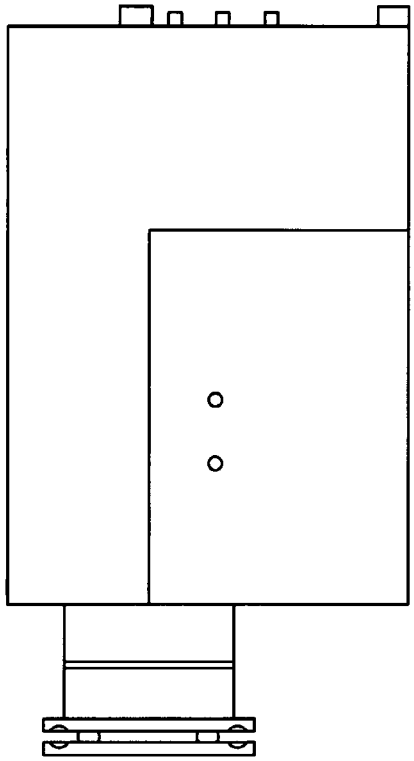
FIG. 10 is a left side view of the embodiment of FIG. 1.
Figure 11:
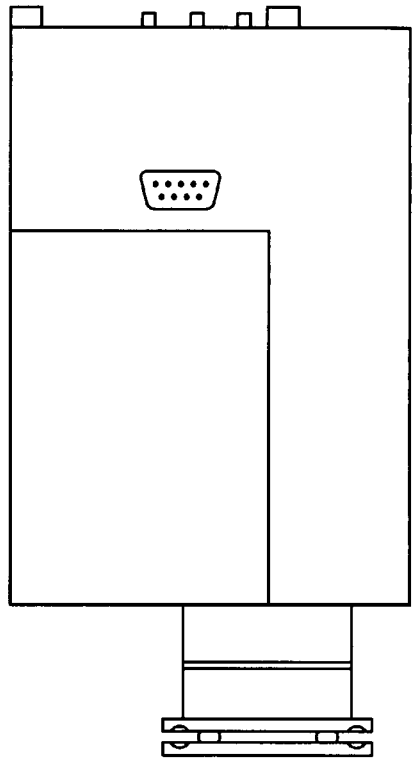
FIG. 11 is a right side view of the embodiment of FIG. 1.
Figure 12:
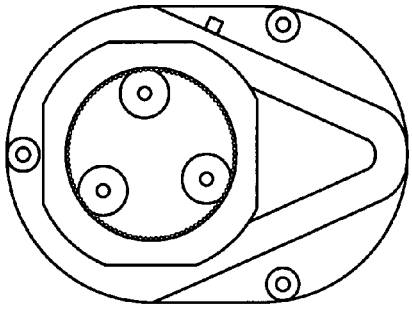
FIG. 12 is a bottom view of the embodiment of FIG. 1.

As shown in FIGS. 1 through 17, the present invention provides for a torque measuring apparatus 116 for use by a user 100 having a first hand 102 and a second hand 104 with each hand having digits 106 and a palm 108. The user's fingers will be referred to in the conventional manner including the thumb and the index, middle, ring, and pinkie fingers.

The torque measuring apparatus 116 of the present invention was originally designed for measuring the torque for opening a container 110 which is shown as a conventional bottle typically used for soft drinks or water have a thin wall plastic bottle shell 114. The container 110 is sealed by a bottle cap 112 in the well known manner using a cap 112 with side ribs, internal threads, and sealing flanges. One of the problems currently encountered in the bottle capping industry is that the continued removal of material from the bottle shell 114 has made the container extremely weak in terms of its ability to withstand a twisting load. Thus, the deflection and energy absorption of the bottle shell 114 has begun to have an impact on the torque required to open or close a container 110. In manufacturing this problem has been solved by modification of the capping machines to operate off of the capping head and lifter ring of the bottle. However, in the commercial marketplace a user will still tend to grasp the bottle shell 114 in order to twist the bottle cap 112 in relation to the bottle 110. Thus, an accurate measurement of the torque required for this expected user load must be acquired in a real world environment.

The present invention is directed to a torque measuring apparatus 116 have a body 118 defining a hollow recess 120. The body 118 is formed from a first body segment 122, a second body segment 136, a third body segment 146, a fourth body segment 154, and a fifth body segment 162.

The first body segment 122 is made using a top 124 with a downwardly extending first segment side wall 126 ending in a joining rabbit groove 128. The top 124 defines upper connector apertures 130, a display aperture 132, and switch apertures 134 for the connection and mounting of other parts.

The second body segment 136 includes a second segment side wall 138 having a wall shoulder 140 for reduction to the angled design and an output aperture 142 for the serial port described infra. The second body segment also defines an internal type of upper connector guides 144 for securing the body segments together.

The third body segment 146 has an angular shaped side wall 148 with upper connector grasping blocks 150 and lower connecting grasping blocks 152.

The fourth body segment 154 is made using an angular shaped side wall 156 defining switch apertures 158 and internally defining lower connector guides 160.

The fifth body segment 162 is made using a bottom 164 with a lower projecting gauge wall 166 defining lower connector apertures 168 and a strain gauge aperture 170.

The upper connecting rods 172 include a head with a driving connection such as a Phillips slot or hex wrench aperture and extend outward with an at least partially threaded shank. The threaded shank passes through the upper connector apertures 130, the internal type of upper connector guides 144 and threadable engages threads defined by the upper connector grasping blocks 150 in the third body segment. In this manner the upper body segments are attached together.

Similarly, the lower connecting rods 174 also include a driving head and an at least partially threaded shank. The lower connecting rods 174 pass downward through the lower connecting grasping blocks 152 and the lower connector guides 160 through the lower connector apertures 168 and threadably engage internal threads in the gauge mounting plate 176 to secure together the lower body segments.

The gauge mounting plate 176 is used to mount a strain gauge 178 connected to a cap chuck 180. The cap chuck is a design having a side wall defining a cap receiving aperture with a round port 182 for vacuum relief and knurled spaced ridges 184 for contacting the side of the cap. The cap chuck 180 is secured to the strain gauge 178 by cap connecting rods 186.

The strain gauge 178 is adapted to provide a torque signal 194 into a torque measuring electrical circuit 188. The torque signal 194 runs through a signal amplifier 196 powered by a power source 190 shown as a battery 192. The battery also provides power form the rest of the electrical circuit including the microprocessor board 200. The amplified torque signal is received by an information capturing system 198. The information capturing system 198 includes a microprocessor board 200 connected to a store control switch 202, a reset control switch 204, a power control switch 206, a scroll-up control switch 208, a scroll-down control switch 210, a display screen 212, and an output port.

The display screen is adapted to display a register identifier 216, a register value 218, and a current measured value 220. The output port 222 is adapted to provide external communication through an IEEE standard serial interface.

Figure 13:
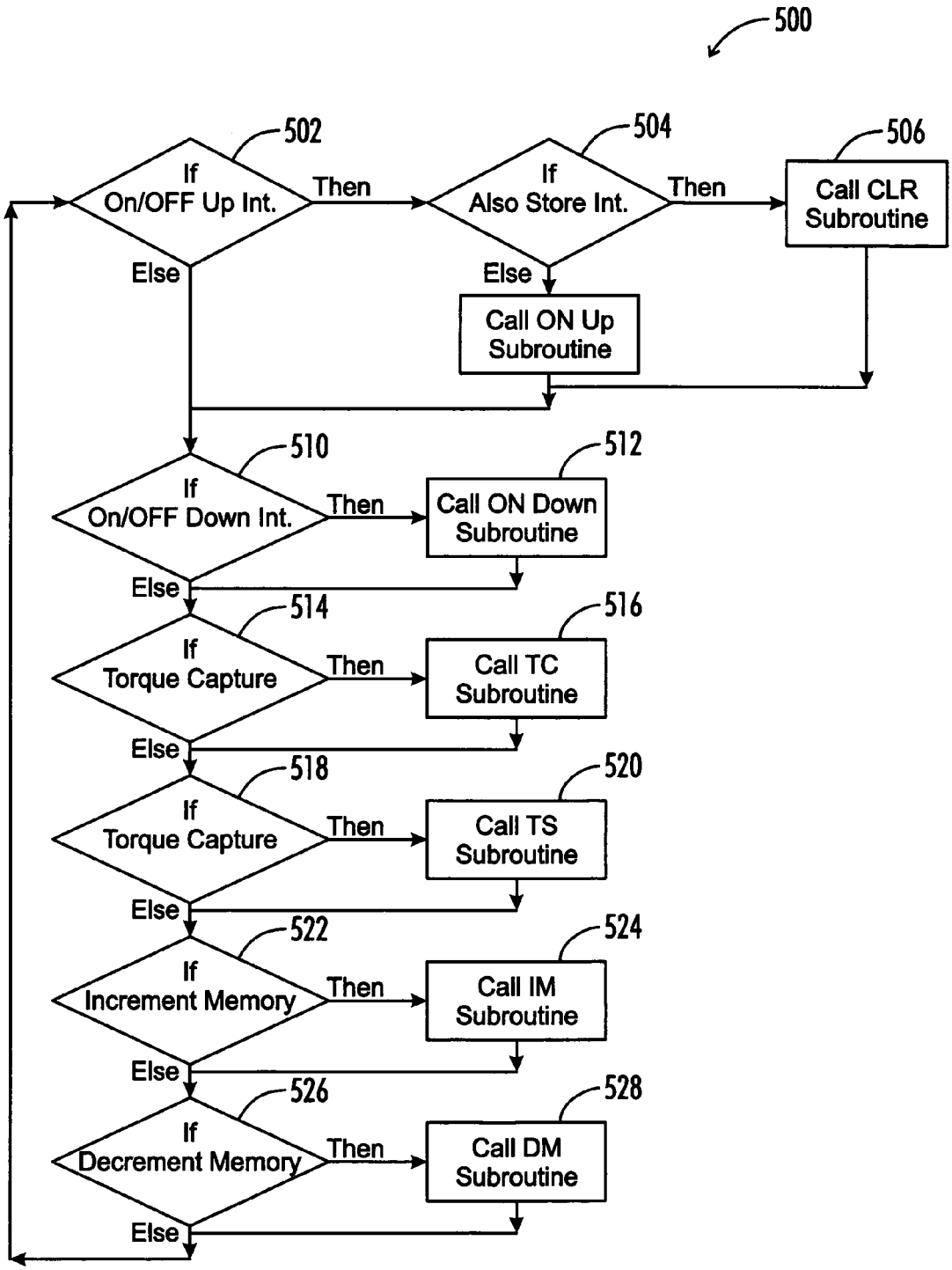
FIG. 13 is a flow chart of the program operating sequence.
Figure 14:
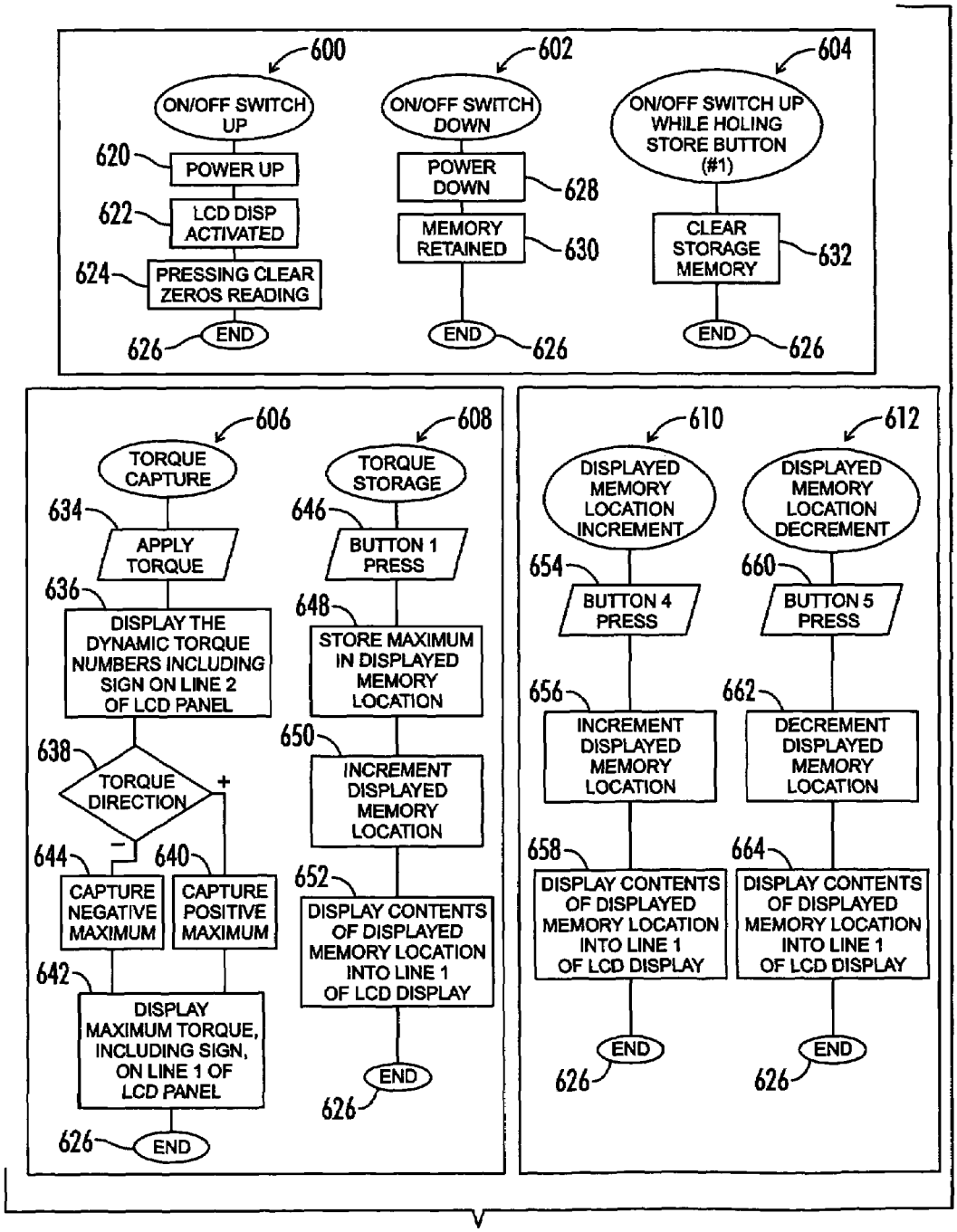
FIG. 14 is a flow chart of the subroutines.

FIGS. 13-14 of the drawings shows the program flow 500 for the microprocessor board operation. The microprocessor waits for an interrupt to take action and then calls the appropriate subroutine for the action.

As shown by the program flow 500 chart of FIG. 13, the system queries to see if this is a power button up interrupt 502. If it is, then the system queries to see if the store button is also activated 504. If both the power button is up and the store button is activated then the Clear Subroutine is called 506. If just the power button is up then the Power Up Subroutine is called 508. If it is not a power up interrupt then the system check to see if it is a power down interrupt 510 and call the Power Down Subroutine if appropriate 512.

Next, the system will check for a torque capture interrupt 514 and call the Torque Capture Subroutine if appropriate 516. The system will then check for a torque storage interrupt 518 and call the Torque Storage Subroutine if appropriate 520. Similarly, the system will check for an increment memory interrupt 522 and call the Increment Memory Subroutine if appropriate 524. The system will then check for a decrement memory interrupt 526 and then call the Decrement Memory Subroutine if appropriate 528 before returning to check for the next interrupt.

FIG. 14 of the drawings shows the various subroutines for the microprocessor board. These include the Power Up Subroutine 600; the Power Down Subroutine 602; the Clear Subroutine 604; the Torque Capture Subroutine 606; the Torque Storage Subroutine 608; the Increment Memory Subroutine 610; and the Decrement Memory Subroutine 612.

The Power Up Subroutine 600 will first power up 620 the circuit and activate 622 the LCD display before checking to see if the clear button has been pressed to clear the reading 624 before ending to return control to the interrupt program 626.

The Power Down Subroutine 602 will power down the circuit 628 and set to retain the memory 630 before ending to return control to the interrupt program 626.

The Clear Subroutine 604 will simply clear the memory storage 632 before ending to return control to the interrupt program 626.

The Torque Capture Subroutine 606 will read the applied torque 634 and display the dynamic torque on the display 636. The subroutine 606 will then check the direction of the torque 638 and record with the positive 640 or negative 644 maximum and record the highest value from zero on the display 642 before ending to return control to the interrupt program 626.

The Torque Storage Subroutine 608 will initiate on a button press 646 to store the maximum into the memory location 648 and then increment the location 650 and display the new memory locations values 652 before ending to return control to the interrupt program 626.

The Increment Memory Subroutine 610 will initiate on a button press 654 to increment the displayed location 656 and display the new locations contents 658 before ending to return control to the interrupt program 626.

The Decrement Memory Subroutine 612 will initiate on a button press 660 to decrement the displayed location 662 and display the new locations contents 664 before ending to return control to the interrupt program 626.

Figure 15:
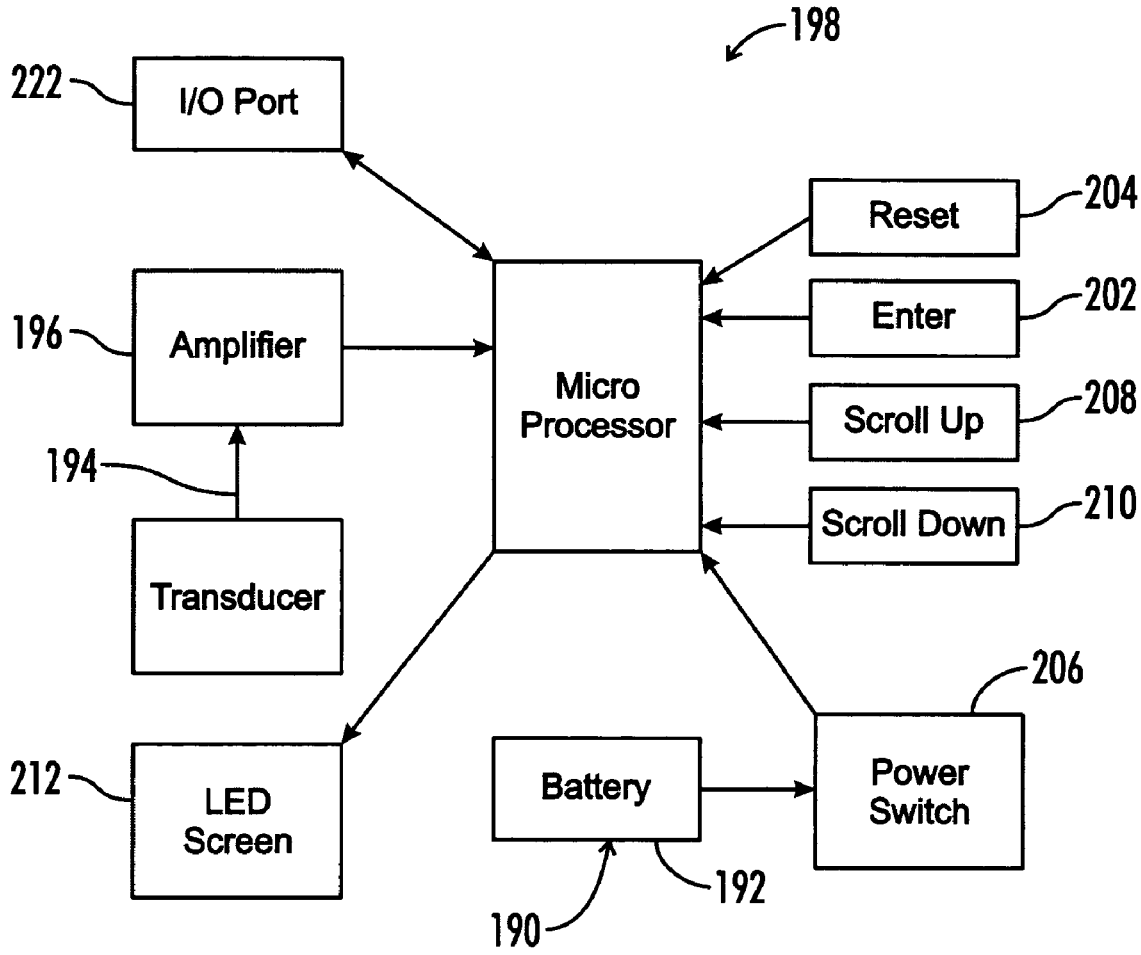
FIG. 15 is a schematic of the signal processing connections.
Figure 16:
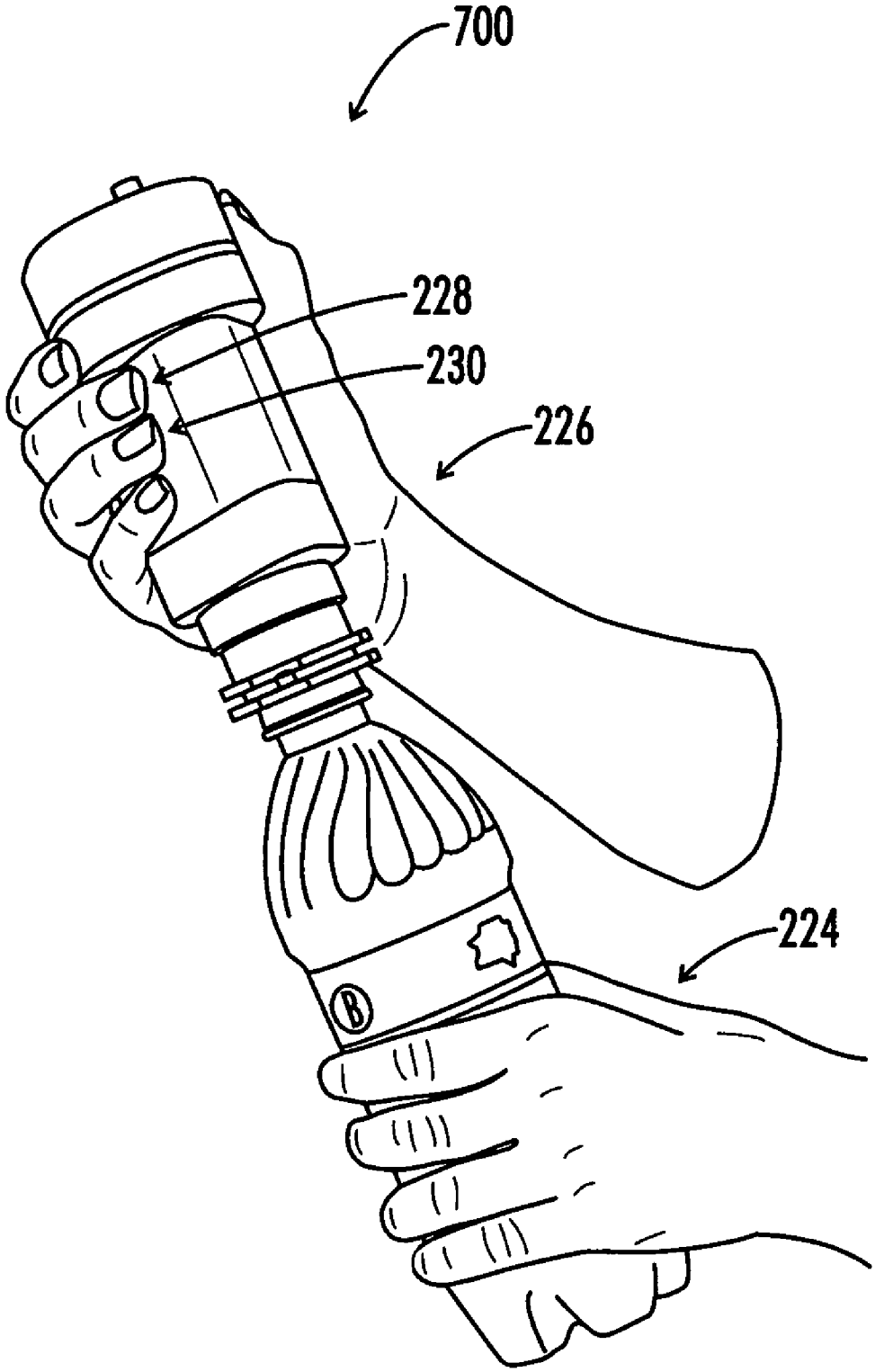
FIG. 16 is a side operational view showing an initial hand position.
Figure 17:
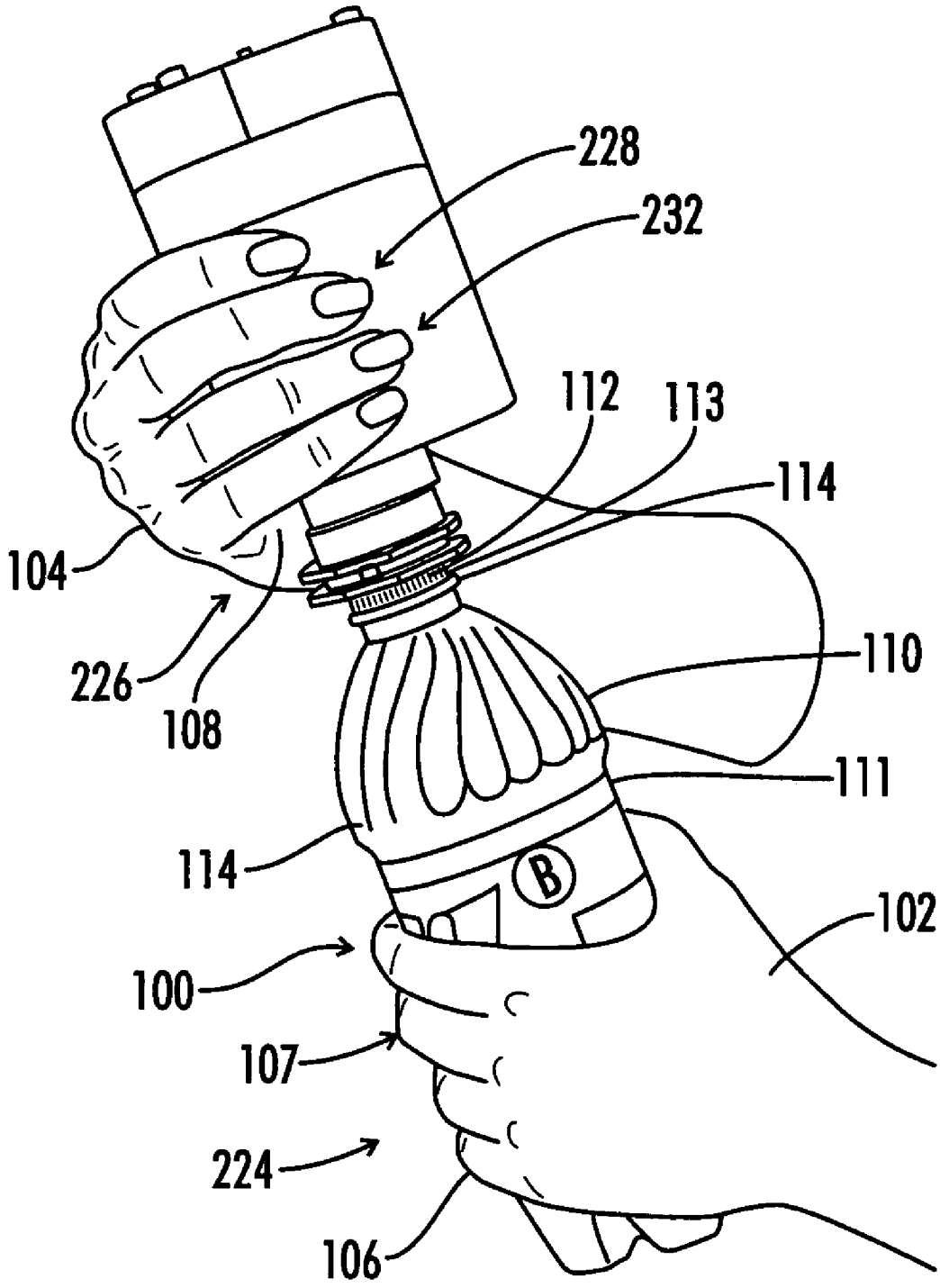
FIG. 17 is a side operational view showing a rotated hand position.

FIG. 15 of the drawings shows an overview of the connections into the microprocessor 200 including an I/O port 222 for serial communication with an external computer system for uploading information such as new programming and downloading the memory of the unit to read the stored values. Also shown are the understood Reset 204, Enter 202, Scroll Up 208, Scroll Down 210, and Power 206 Switches. The power switch 206 relays power from the battery 192. Also connected to the microprocessor 200 are the screen 212 and the Transducer 178 through an amplifier/regular 196 to convert the transducer signal to the appropriate value.

As noted by the description of this device, a method for reading the torque for installing or removing a bottle cap is taught. The method includes holding the bottle in the first hand 224 and holding a torque measuring device in the second hand 226. The user may begin the read by activating a store function 228 which begins the process for detecting and storing the maximum torque value. It is also envisioned that with sufficient memory, a torque curve could be recorded with multiple readings across the entire cap movement process to obtain additional information about the removal torque. As noted by the programming sequence, additional step for the user may include activating a reset function 230 to clear the register and record a new value or advancing to a subsequent register 232 so that multiple values may be recorded into the device for later use.

Numbers used in the drawings correspond to the following:

a user 100
a first hand 102
a second hand 104
digits 106
fingers 107
a palm 108
a container 110
a conventional bottle 111
a thin wall plastic bottle shell 114
a bottle cap 112
side ribs 113
lifter ring 114
a torque measuring apparatus 116
a body 118
a hollow recess 120
a first body segment 122
a top 124
upper connector apertures 130
a display aperture 132
switch apertures 134
a downwardly extending first segment side wall 126
a joining rabbit groove 128
a second body segment 136
a second segment side wall 138
a wall shoulder 140
an output aperture 142
an internal type of upper connector guides 144
a third body segment 146
an angular shaped side wall 148
upper connector grasping blocks 150
lower connecting grasping blocks 152
a fourth body segment 154
an angular shaped side wall 156
switch apertures 158
lower connector guides 160
a fifth body segment 162
a bottom 164
a lower projecting gauge wall 166
lower connector apertures 168
a strain gauge aperture 170
upper connecting rods 172
a head 173
lower connecting rods 174
a driving connection 175
gauge mounting plate 176
at least partially threaded shank 177
a strain gauge 178
a cap chuck 180
a side wall 181
around port 182
a cap receiving aperture 183
knurled spaced ridges 184
cap connecting rods 186
a torque signal 194
a torque measuring electrical circuit 188
a signal amplifier 196
a power source 190
a battery 192
an information capturing system 198
a microprocessor board 200
a store control switch 202
a reset control switch 204
a power control switch 206
a scroll-up control switch 208
a scroll-down control switch 210
a display screen 212
a register identifier 216
a register value 218
a current measured value 220
an output port 222
program flow 500
check power up interrupt 502
check store button 504
call Clear Subroutine 506
call Power Up Subroutine 508
check power down interrupt 510
call Power Down Subroutine 512
check torque capture interrupt 514
call Torque Capture Subroutine 516
check torque storage interrupt 518
call Torque Storage Subroutine 520
check increment memory interrupt 522
call Increment Memory Subroutine 524
check decrement memory interrupt 526
call Decrement Memory Subroutine 528
Power Up Subroutine 600
Power Down Subroutine 602
Clear Subroutine 604
Torque Capture Subroutine 606
Torque Storage Subroutine 608
Increment Memory Subroutine 610
Decrement Memory Subroutine 612
Circuit power up 620
LCD activation 622
clear reading 624
end return control 626
Circuit power down 628
retain memory 630
clear memory storage 632
read applied torque 634
display dynamic torque 636
check torque direction 638
record positive maximum 640
record negative maximum 644 report high value on display 642
storage button press 646
store maximum value 648
increment memory location 650
display new memory locations 652
increment button press 654
increment displayed location 656
display new location contents 658
decrement button press 660
decrement displayed location 662
display new location contents 664
method for reading 700
holding the bottle in the first hand 224
holding a torque measuring device in the second hand 226
activating a store function 228
activating a reset function 230
record a new value or advancing to a subsequent register 232

From the foregoing, it will be seen that this invention well adapted to obtain all the ends and objects herein set forth, together with other advantages which are inherent to the structure. It will also be understood that certain features and subcombinations are of utility and may be employed without reference to other features and subcombinations. This is contemplated by and is within the scope of the claims. Many possible embodiments may be made of the invention without departing from the scope thereof. Therefore, it is to be understood that all matter herein set forth or shown in the accompanying drawings is to be interpreted as illustrative and not in a limiting sense.

What is claimed is:

1. A torque measuring apparatus adapted to be held by digits and a palm of a first hand of a user for measuring torque for turning a bottle cap connected by threads to a bottle the bottle adapted to be held by a second hand of the user, the apparatus comprising:

a single body adapted to be held by the first hand of the user;

a strain gauge mounted to the body, the strain gauge adapted to output a torque signal;

a cap chuck mounted to the stain gauge, the cap chuck adapted to fit the bottle cap;

a microprocessor electrically connected to the strain gauge and adapted to record a measurement associated with the torque signal;

a store control switch electrically connected to the microprocessor, the microprocessor housed within the body the store control switch operable by at least one digits on the first hand of the user while holding the body in the first hand.

2. The apparatus of claim 1, further comprising:

a reset control switch electrically connected to the microprocessor, the reset control switch operable by at least one digits on the first hand of the user.

3. The apparatus of claim 1, further comprising:

a power control switch electrically connected to the microprocessor, the power control switch operable by at least one digits on the first hand of the user.

4. The apparatus of claim 1, further comprising:

a scroll-up control switch electrically connected to the microprocessor, the scroll-up control switch operable by at least one digits on the first hand of the user.

5. The apparatus of claim 1, further comprising:

a scroll-down control switch electrically connected to the microprocessor, the scroll-down control switch operable by at least one digits on the first hand of the user.

6. The apparatus of claim 1, further comprising:

A display screen electrically connected to the microprocessor, the display screen adapted to provide a visual output for the apparatus.

7. The apparatus of claim 1, further comprising:

The display screen adapted to provide an indication of a register identifier.

8. The apparatus of claim 1, further comprising:

The display screen adapted to provide an indication of a register value.

9. The apparatus of claim 1, further comprising:

The display screen adapted to provide an indication of a current measured value.

10. The apparatus of claim 1, further comprising:

an output port electrically connected to the microprocessor.

11. A method for measuring hand held torque, the method comprising:

providing a bottle, a cap, and a user with a first hand and a second hand, at least one hand having digits;

holding the bottle in the first hand;

holding a single-bodied measuring device in the second hand;

applying the torque measuring device to the cap;

twisting the cap-applied torque measuring device in relation to the bottle, as held by the user in the user's first and second hands, the torque measuring device using a strain gauge connected to an information processing system for storing a torque measurement value, the information processing system located within the torque measuring device; and using at least one digit on the second hand for activating a store function while holding the torque measuring device.

12. The method of claim 11, further comprising:

using at least one digit on the second hand for activating a reset function.

13. The method of claim 11, further comprising:

using at least one digit on the second hand for advancing to a another register.

14. A torque measuring apparatus adapted to be held by digits and a palm of a first hand of a user for measuring torque for turning a bottle cap connected by threads to a bottle, the bottle adapted to be held by a second hand of the user, the apparatus comprising:

a supporting means for providing a single base structural support adapted to be held by the first hand of the user;

a torque measuring means mounted to the supporting means, the torque measuring means adapted to provide an output value;

a cap holding means for engaging the bottle cap, the cap holding means mounted to the torque measuring means;

a value capturing means for capturing the output value; and a digit operable store activating means for activating the value capturing means while holding the the supporting means, the digit operable store activating means mounted on the supporting means.

15. The apparatus of claim 14, further comprising:

a digit operable reset means for clearing the output value.

16. The apparatus of claim 14, further comprising:

a digit operable power control means for activating the torque measuring apparatus.

17. The apparatus of claim 14, further comprising:

a digit operable scroll activating means for moving between storage locations in the value capturing means.

18. The apparatus of claim 14, further comprising:

a sensory conversion means connected to the value capturing means, the sensory conversion means adapted to generate sensory detectable output.

19. The apparatus of claim 18, the sensory conversion means including a visual output means for providing a visually detectable output.

20. The apparatus of claim 18, the sensory conversion means adapted to provide an indication of a current measured value.

* * * * *